US006408222B1

(12) United States Patent
Kim et al.

(10) Patent No.: US 6,408,222 B1
(45) Date of Patent: Jun. 18, 2002

(54) APPARATUS AND A METHOD FOR CONTROLLING THICKNESS OF A STRIP IN A TWIN ROLL STRIP CASTING DEVICE

(75) Inventors: Yoon Ha Kim; Hi Jung Lee; Dae Sung Lee, all of Kyungsangbook-do (KR)

(73) Assignees: Pohang Iron & Steel Co., Ltd.; Research Institute of Industrial Science & Technology, both of (KR)

( * ) Notice: Subject to any disclaimer, the term of this patent is extended or adjusted under 35 U.S.C. 154(b) by 0 days.

(21) Appl. No.: 09/367,979

(22) PCT Filed: Dec. 23, 1998

(86) PCT No.: PCT/KR98/00455

§ 371 (c)(1),
(2), (4) Date: Aug. 23, 1999

(87) PCT Pub. No.: WO99/33595

PCT Pub. Date: Jul. 8, 1999

(30) Foreign Application Priority Data

Dec. 24, 1997 (KR) ..... 97-73580

(51) Int. Cl.[7] ..... G06F 19/00

(52) U.S. Cl. ..... 700/155; 164/452; 700/156; 72/9.2

(58) Field of Search ..... 700/155, 156, 700/129, 146, 148, 150; 702/97; 72/8.1, 9.2, 10.1, 10.3, 10.7, 11.8; 164/452, 480, 154.4, 154.5, 428

(56) References Cited

U.S. PATENT DOCUMENTS 5,706,882 A * 1/1998 Fellus et al. ..... 164/452

FOREIGN PATENT DOCUMENTS

| | | |
|---|---|---|
| EP | 0095352 | 11/1983 |
| EP | 0411962 | 2/1991 |
| WO | WO9202321 | 2/1992 |

* cited by examiner

*Primary Examiner*—William Grant
*Assistant Examiner*—Steven R. Garland
(74) *Attorney, Agent, or Firm*—Webb Ziesenheim Logsdon Orkin & Hanson, P.C.

(57) ABSTRACT

A strip thickness control method in a twin roll strip casting device having a fixed roll and a horizontally movable roll, the method including the steps of: measuring a movement value Gj(θ) of journals of the fixed and movable rolls and a movement value Gg(θ+π) of barrels of the rolls; predicting a movement value Mfcr(θ) of a roll nip of the fixed roll and a movement value Mmcr(θ) of a roll nip of the movable roll from the movement values Gj(θ) and Gg(θ+π); calculating a difference value between the movement values Mfcr(θ) and Mmcr(θ) to obtain an amount of variation Mdiff(θ) of a gap between the fixed and movable rolls; and controlling thickness of a strip to minimize the amount of variation Mdiff(θ) of the gap between the rolls.

10 Claims, 2 Drawing Sheets

APPARATUS AND A METHOD FOR CONTROLLING THICKNESS OF A STRIP IN A TWIN ROLL STRIP CASTING DEVICE

The present invention relates to a twin roll strip casting device for casting the strip directly from a molten metal, and more particularly to an apparatus and a method for controlling a thickness of the strip in a twin roll strip casting device which can predict and compensate the thickness deviation of the strip caused by the eccentricity of roll and the movement of center of the roll, while maintaining the uniform gap between rolls in the casting process.

BACKGROUND OF THE INVENTION

Generally, a twin roll strip casting device is used for directly casting a strip 5 by the rotation of the casting rolls 1 and 2 within a molten iron pool 3. In this case, the thickness of the cast strip 5 is dependent upon the gap between the rolls 1 and 2, i. e. the minimum distance between the rolls 1 and 2, roll nip.

To maintain the uniform thickness of the strip 5 in the twin roll strip casting device, therefore, the distance between the rolls 1 and 2 should be kept at a uniform distance.

To manufacture the desired thickness of strip, the thickness of the strip should be accurately measured, but a conventional measuring method using a contact sensor has the following disadvantages. During casting of the strip, since the temperature of the strip is very high, it is impossible to measure the thickness of the strip with this contact sensor. Since the failure of the thickness measurement of the strip means the failure of the measurement of the gap between the rolls, the gap between the rolls can not be measured accurately. Accordingly, a contact sensor 45 may be mounted between chocks 44 of rolls 41 and 42 to measure the gap between the rolls 41 and 42 so as to control the thickness of the strip, as shown in FIG. 4.

The gap between the rolls 41 and 42, that is, the thickness of the strip means the distance of the roll nip 46 as a minimum distance between the fixed roll 41 and the horizontal moving roll 42. In the conventional method, this means that only the gap between the chocks may be measured to measure the thickness of the strip instead of practical gap distance between the rolls. As a result, the conventional method is an indirectly measuring method.

In the conventional method for measuring the gap between the chocks 44, therefore, since the variation of the gap between the rolls 41 and 42 caused by the eccentricity of the rolls in the casting process and the upper/lower and left/right movements of the rolls 41 and 42 caused by the movements of the centers of the rolls can not be detected when rotating the rolls, the information related to the variation of the roll gap and the movement of the rolls cannot be utilized for measuring of the thickness of the strip. Therefore, the accuracy for measurement and strip thickness is deteriorated.

To overcome the above disadvantages and problems, a roll eccentricity compensation system has been introduced, in which the error value of the thickness of the strip is compensated using the roll separation force(RSF) of rolls caused by the eccentricity of the rolls during the rotation of rolls. However, since the RSF of the roll is created due to various kinds of factors such as the change of casting velocity, the change of the gap between the rolls, the change of the height of the molten pool, and skull flowing between the rolls, there occurs a problem that the RSF is not effective. Moreover, a method of compensating the variation of the thickness of the strip caused by the movements of the centers of rolls is not yet suggested in the conventional roll eccentricity compensation system.

SUMMARY OF THE INVENTION

An object of the present invention is to provide an apparatus and a method for controlling thickness of the strip in a twin roll strip casting device which can predict and compensate the thickness deviation of the strip caused by the eccentricity of rolls and the movements of centers of the rolls, while maintaining the uniform gap between the rolls in the casting process.

In order to achieve this object, the apparatus according to present invention comprises a fixed roll and a horizontally movable roll, a first sensor attached on a journal to measure an amount of variation between the journals of the fixed and horizontally moving movable rolls, second and third non-contacting sensors each mounted on the rear side of the barrels of the fixed and horizontally movable rolls to sense movements of the barrels of the fixed and horizontally movable rolls, first and second subtracters for each subtracting the amount of variation between the journals of the fixed and horizontally movable rolls which is sensed by the first sensor from the movements of the barrels of the fixed and horizontally movable rolls which are sensed by the second and third sensors, a controlling unit for processing input signals from the first and second subtracters to calculate an amount of variation of roll nip to eliminate a high frequency component from the calculated signal, and a roll gap controlling unit for controlling the gap between the rolls in accordance with the input signal of the controlling unit.

Preferably, the controlling unit comprises first and second buffers for each storing output signals from the first and second subtracters and for inverting the phase of the stored signals by 180° to output the phase-inverted signals, first and second adders for adding the amount of variation between the journals of the rolls which is sensed by the first sensor to each of the output signals from the first and second buffers, a third subtracter for subtracting the output signal of the first adder from the output signal of the second adder to thereby calculate the amount of the variation of the roll nip, a gap trim predictor for generating an error compensating signal by the signal to be inputted from the third subtracter, and a fast Fourier transformer for performing Fourier transform for the error compensating signal from the gap trim predictor to output the transformed signal out of which the high frequency component is eliminated.

The roll gap controlling unit includes a fourth subtracter for adding the error compensating signal from the fast Fourier transformer to a desired value of the roll gap and for subtracting a measured value of the roll gap from this added value, a roll gap measuring sensor mounted between the chocks of the rolls to measure the roll gap between the chocks, a PID controller for outputting a control signal to increase the roll gap if the desired value of the roll gap added to the error compensating signal is higher than the measured value of the roll gap, and to decrease the roll gap if lower, in accordance with the compared result of the fourth subtracter, and a servo valve operated according to the control signal from the PID controller to move the movable roll.

Further, a control method for the thickness of the strip having a fixed roll and a horizontally movable roll includes the steps of measuring a movement value $Gj(\theta)$ of journals of the fixed and horizontally movable rolls and a movement value $Gg(\theta+\pi)$ of barrels of the rolls, predicting a movement value Mfcr(θ) of a roll nip of the fixed roll and a movement value Mmcr(θ) of a roll nip of the movable roll from the movement values Gj(θ) and Gg(θ+π); calculating a difference value between the movement values Mfcr(θ) and Mmcr(θ) to obtain an amount of gap variation Mdiff(θ) between the roll nip, and controlling thickness of a strip to minimize the amount of variation Mdiff(θ) of the gap between the roll nip.

BRIEF DESCRIPTION OF THE DRAWINGS

Other objects and aspects of the invention will become apparent from the following description of embodiments with reference to the accompanying drawings in which.

DETAILED DESCRIPTION OF THE INVENTION

Hereinafter, an explanation on the construction and operational effect of a strip thickness control device and method in a twin roll strip casting device according to the present invention will be discussed in detail accompanying FIGS. 2 and 3.

Figure 1:
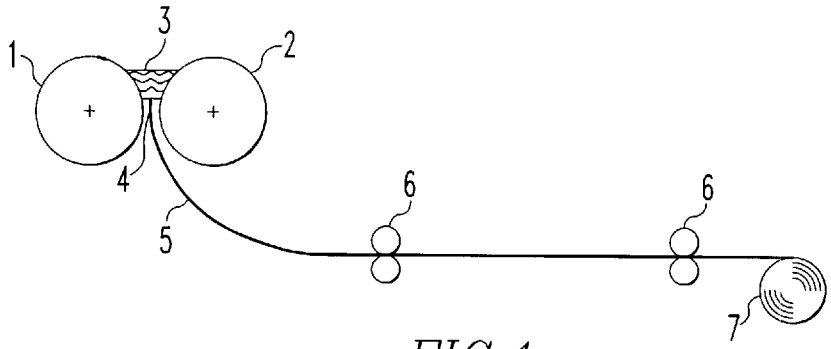
FIG.1 PRIOR ART
FIG. 1 is a schematic view of a general twin roll strip casting device.
Figure 2:
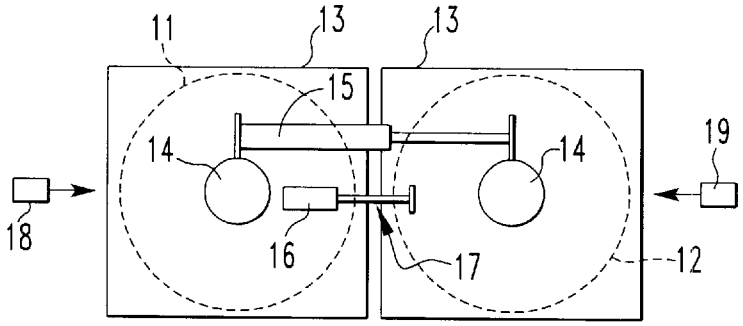
FIG. 2 is a schematic view illustrating a plurality of sensors which are mounted to control the thickness of a strip on the twin roll strip casting device according to the present invention.
Figure 4:
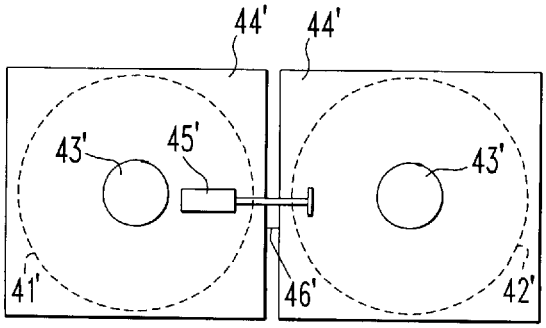
FIG.4 PRIOR ART
FIG. 4 is a schematic view illustrating installation of a roll gap measuring sensor in a conventional control device.

FIG. 2 is a schematic view illustrating a plurality of sensors mounted on the twin roll strip casting device according to the present invention. Reference numerals 11 and 12 each indicate a fixed roll and a horizontally movable roll in the twin roll strip casting device, 13 indicates a chock surrounding the rolls 11 and 12, respectively, 14 indicates a journal attached on the center of each of the rolls 11 and 12, 15 indicates a contact distance sensor for sensing the distance between the journals 14 of the rolls 11 and 12, that is, an amount of the movement of the journals 14, 16 denotes a contact distance sensor mounted on the chocks 13 to sense a gap between the rolls, 17 designates roll nip of the rolls 11 and 12, 18 indicates a non-contact distance sensor mounted adjacent to the fixed roll 11 to detect movement of a barrel of the fixed roll 11, and 10 indicates a non-contact distance sensor mounted adjacent to the movable roll 12 to detect movement of a barrel of the movable roll 12.

Figure 3:
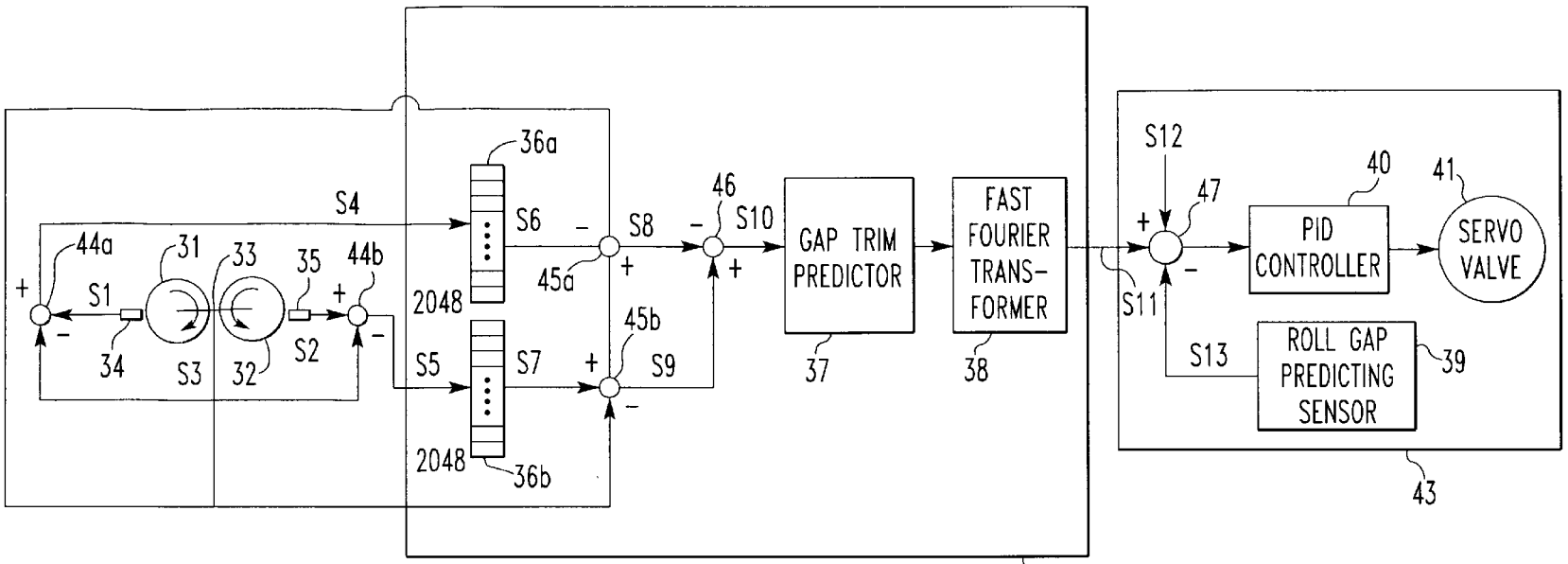
FIG. 3 is a block diagram illustrating a thickness control loop according to the control method according to the twin roll strip casting device of the present invention.

FIG. 3 is a block diagram illustrating construction of a strip thickness control device in which a method for controlling the thickness of the strip according to the present invention is embodied. As shown in this figure, the strip thickness control device includes the fixed roll 31 and the horizontally movable roll 32, a first distance sensor 33 for sensing the variation amount S3 of the gap between the journals of the fixed and horizontally movable rolls 31 and 32; a second distance sensor 34 for sensing movement S1 of the barrel of the fixed roll 31, a third distance sensor 35 for sensing movement S2 of the barrel of the horizontally movable roll 31, a first subtracter 44*a* for subtracting S3 between the journals of the fixed and horizontally movable rolls 31 and 32 sensed by the first distance sensor 33 from the movement S1 of the barrel of the fixed roll 31 sensed by the second distance sensor 34, a first buffer 36*a* for storing an output signal S4 from the first subtracter and for inverting the phase of the stored signals by 180° to output the phase-inverted signal, a second subtracter 44*b* for subtracting the amount of variation S3 between the journals of the fixed and horizontally movable rolls 31 and 32 sensed by the first distance sensor 33 from the movement S2 of the barrel of the horizontally movable roll 32 sensed by the third distance sensor 35, a second buffer 36*b* for storing an output signal S5 from the second subtracter and for inverting the phase of the stored signals by 180° to output the phase-inverted signal, first and second adders for adding the amount of variation S3 between the journals of the fixed and horizontally movable rolls 31 and 32 sensed by the first distance sensor to each of output signals S6 and S7 from the first and second buffers 36*a* and 36*b*, a third subtracter 46 for subtracting the output signals S5 and S9 of the first and second adders 45*a* and 45*b* from the output signal S9 of the second adder 45*b*, a gap trim predictor 37 for generating an error compensating signal by signal S10 from the third subtracter 46, a fast Fourier transformer 38 for performing Fourier transform for the error compensating signal from the gap trim predictor 37 and for outputting the transformed signal S11 out of which high frequency components are removed, a fourth subtracter for adding the error compensating signal from the fast Fourier transformer 38 to a desired value S12 of the roll gap and for subtracting a measured value S13 from the added desired value of the roll gap, a roll gap measuring sensor 39 mounted between the chocks of the fixed and horizontally movable rolls 31 and 32 to measure the roll gap, a PID controller 40 operated by the control signal to increase the roll gap ff the desired value S12 of the roll gap to which the error compensating signal S11 is added is higher than the roll gap measured value S13, and to decrease the roll gap if lower, in accordance with the compared result of the fourth subtracter 47, and a servo valve 41 for moving the horizontally movable roll 32 in accordance with the control signal of the PID controller 40.

Now, an explanation of the basic principles of the roll gap trim prediction for controlling the thickness of strip according to the present invention will be discussed.

In the twin roll strip casting device, one of the fundamental aims is to recognize the movement of the roll nip. However, since the measurement of the movement of the roll nip is impossible, the movement of the roll nip should be predicted with the measurable data. In case of the rotation of the fixed roll and the horizontally movable roll, assuming that the movement of roll barrel is Gg(θ+π), the movement of the journal of the roll is Gj(θ), the movement of the roll barrel due to the eccentricity of the roll is E(θ+π), and the movement of the roll nip due to the eccentricity of the roll is E(θ), the above measurable data correspond to the movement value Gj(θ) of the journal of the roll and the movement value Gg(θ+π) of roll barrel.

If the movement value of the roll is generally described during the rotation of the roll, it is assumed that the complex movement values caused by the eccentricity of roll and the movement of the center of roll occur. The overall movement of the roll which is generated on the barrel of the roll is generally expressed as the barrel movement value Gg(θ+π). The overall barrel movement value Gg(θ+π) is measured by means of the second distance sensors 34 and 35 and the other journal movement value Gj(θ) is measured by means of the first distance sensor 33. At this time, the Gg(θ+π) and Gj(θ) are measurable.

The movement value Gg(θ+π) of roll barrel has a phase difference by 180° from the movement of the roll nip, and contrarily, the movement value Gj(θ) of the journal of the roll has the same phase as the movement of the roll nip. The movement value $E(\theta+\pi)$ of the roll barrel due to the eccentricity of the roll has a phase difference by 180° from an amount of the eccentricity which is generated on the roll nip and is not measurable. Accordingly, the movement value $E(\theta)$ of the roll nip due to the eccentricity of the roll, which has a phase difference by 180° from the movement value $E(\theta+\pi)$ of the roll barrel due to the eccentricity of the roll, is not measurable.

Above all, the movement value for accurate control of the thickness of strip is the overall movement value $M(\theta)$ generated on the roll nip. The overall movement value $M(\theta)$ is defined as a movement value obtained by adding the movement value of the roll nip due to the eccentricity of roll and the movement value of the journal of roll, i.e., $E(\theta)+Gj(\theta)$. In this case, thus, to calculate the overall movement value $M(\theta)$, the measurable movement values $Gg(\theta+\pi)$ and $Gj(\theta)$ should be utilized.

The movement value $Gg(\theta+\pi)$ of the roll barrel at the state where the movement value $Gj(\theta)$ of the journal of the roll is measured is caused by the movement value $Gj(\theta)$ of the journal of the roll and the eccentricity value $E(\theta+\pi)$ of the roll barrel. Therefore, this may be expressed as the equation $Gg(\theta+\pi)=E(\theta+\pi)+Gj(\theta)$. From the above expression, another expression $E(\theta+\pi)=Gg(\theta+\pi)-Gj(\theta)$ can be obtained. In more detail, the movement value $E(\theta+\pi)$ of the roll barrel due to the eccentricity of the roll is calculated by the difference value between the movement value of the roll barrel $Gg(\theta+\pi)$ and the movement value $Gj(\theta)$ of the journal of the roll. At this time, if the movement value $E(\theta+\pi)$ of the roll barrel due to the eccentricity of the roll is phase-inverted by 180° , the movement value $E(\theta)$ of the roll nip due to the eccentricity of the roll can be calculated. Therefore, the overall movement value of the roll nip, $M(\theta)=E(\theta)+Gj(\theta)$, can be obtained.

The movement value $Gj(\theta)$ upon calculating the movement value $M(\theta)=E(\theta)+Gj(\theta)$ is different from the movement value $Gj(\theta)$ upon calculating the movement value $Gg(\theta+\pi)=E(\theta+\pi)+Gj(\theta)$. The reason is that the time of calculating the movement value $M(\theta)=E(\theta)+Gj(\theta)$ differs from the time of calculating the movement value $Gg(\theta+\pi)=E(\theta+\pi)+Gj(\theta)$. Therefore, in the process of calculating the movement value $M(\theta)=E(\theta)+Gj(\theta)$, the movement value $Gj(\theta)$ should be newly measured.

In the same manner as the above calculating method, it is assumed that the movement value of the roll nip of the fixed roll is $Mfcr(\theta)$ and the movement value of the roll nip of the horizontally movable roll is $Mmcr(\theta)$. In the twin roll strip casting device, the movement value of the gap between the fixed roll and the horizontally movable roll corresponds to a difference value $Mdiff(\theta)=Mfcr(\theta)-Mmcr(\theta)$. To control accurately the thickness of the strip in an accurate manner, the movement value $Mdiff(\theta)$ of the gap between the roll nip should be decreased, Accordingly, the strip thickness control method in the twin roll strip casting device according to the present invention comprises the steps of predicting the movement value of the gap between the roll nip which defines the thickness of the strip with the movement value of the roll barrel and the amount of variation of the journal gap and compensating the predicted movement value of the gap between the roll nip upon the control of roll gap.

A detailed explanation of the strip thickness control method based upon the above principles is in accompanying FIG. 3.

As shown in this figure, in the casting process, the second and third distance sensors 34 and 35, which are each mounted on the roll barrels of the fixed roll 31 and the horizontally movable roll 32, detect the output signals S1 and S2 indicative of the movement values of the roll barrels when the two rolls rotate.

At the same time, the first distance sensor 33, which is mounted between the journals of the fixed and horizontally movable rolls, detects the output signal S3 indicative of the variation amount of the gap between the journals of the two rolls. In this case, the output signal S3 contains the movement value of the journal of the fixed roll 31 and the movement value of the journal of the horizontally movable roll 32.

Next, to utilize the output signals S1 and S2 indicative of the movement values of the roll barrels which are outputted from the second and third distance sensors 34 and 35 as information data to predict the movement value of the roll nip, the movement value $Gj(\theta)$ of the journal gap as the output signal. S3 detected by the first distance sensor 33 is subtracted from the movement value $Gfcr(\theta+\pi)$ of the roll barrel of the fixed roll 31 as the output signal S1 by means of the first subtracter 44*a,* and the subtracted value is then stored in the first buffer 36*a*. On the other hand, the movement value $Gj(\theta)$ of the journal gap as the output signal S3 detected by the first distance sensor 33 is subtracted from the movement value $Gmcr(\theta+\pi)$ of the roll barrel of the horizontally movable roll 32 as the output signal S2 by means of the second subtracter 44*b,* and the subtracted value is then stored in the second buffer 36*b*. In other words, the movement values $Gfcr(\theta+\pi)-Gj(\theta)$ and $Gmcr(\theta+\pi)-Gj(\theta)$ are correspondingly stored in the first and second buffers 36*a* and 36*b*. As noted above, since $E(\theta+\pi)=Gg(\theta+\pi)-Gj(\theta)$, the stored values can be changed to the movement values $Efcr(\theta+\pi)$ and $Emcr(\theta+\pi)$.

The stored values in the first and second buffers 36*a* and 36*b* are phase-inverted by 180° and are outputted as the eccentricity values $Efcr(\theta)$ and $Emcr(\theta)$. Then, the outputted values are added to the movement value $Gj(\theta)$ of the journal gap by means of the first and second adders 45*a* and 45*b*. As a result, the output signals S8 and S9 from the first and second adders 45*a* and 45*b* correspondingly indicate the movement values $Efcr(\theta)+Gj(\theta)$ and $Emcr(\theta)+Gj(\theta)$, that is, $Mfcr(\theta)$ and $Mmcr(\theta)$ of the roll nip are calculated.

The difference value $Mdiff(\theta)$ between the movement values $Mfcr(\theta)$ and $Mmcr(\theta)$ of the roll nip is calculated by means of the third subtracter 46.

The output signal S10 finally applied to the gap trim predictor 37 indicates the amount of variation of the gap between the roll nip generated by the movement of the roll nip of the fixed roll 31 and the horizontally movable roll 32.

Next, the gap trim predictor 37 outputs a strip thickness error compensating signal to decrease the amount of variation of the gap between the roll nip, and the fast Fourier transformer 38 performs the Fourier transform for the error compensating signal from the gap trim predictor 37 and extracts the low frequency component in an appropriate order from the transformed signal to apply this signal to the roll gap controlling unit 43. In this case, the appropriate ordinal low frequency component ranges from primary harmonics component to third harmonics component.

The fixed roll 41 does not have an actuator for compensating the movement thereof. To precisely control the thickness of the strip, thus, the servo valve 41 as an actuator which is mounted on the horizontally movable roll 31 should compensate the movement of the horizontally movable roll 32 as well as the movement of the fixed roll 31 which is generated during the rotation. The object of the roll gap trim predictor 37 is to minimize the amount of variation of the gap between the roll nip. In the case where the above algorithm is processed optimally, the movement of the roll nip disappears and accordingly the alternating current component does not exist. As a result, the input signal accumulated in the integrator of the roll gap trim predictor converges in a zero state, and thus the divergence of the integrator can be prevented.

If the error compensating signal S11 as a final output signal from the roll gap trim predictor 37 has a high frequency component, however, this causes the unstable state of the roll gap controlling unit 43. This state is undesirable in the present invention. To prevent the above unstable state, only the appropriate order of the low frequency component(primary to third harmonics) is extracted from the error compensating signal S11 by means of the Fast Fourier transformer 38.

Thus, the high frequency component in the strip thickness error compensating signal S11 from the fast Fourier transformer 38 is eliminated, to prevent the control of the servo valve 41 as an actuator in the roll gap controlling unit 43 from being performed in the unstable state.

The strip thickness error compensating signal S11 which has been inputted to the roll gap controlling unit 43 is added to the original roll gap desired value S12 of the roll gap. Next, the added value is compared with the roll gap measured value S13 applied from the roll gap predicting sensor 39 which is mounted between the chocks of the rolls and the compared result is applied to the PID controller 40. At this time, if the value S12 is higher than the added value of the desired value S12 of the roll gap and the strip thickness error compensating signal S11 applied from the controlling unit 42, the PID controller 40 controls the servo valve 41 to decrease the roll gap, and to the contrary, if lower, controls the servo valve 41 to increase the roll gap.

The data which can be used to predict the movement of the gap between the roll nip corresponds to the movement of the journal gap during the rotation of roll and the movement of the roll barrel detected by the distance sensor. Therefore, in the preferred embodiment of the present invention the amount of variation S10 of the gap between the roll nip can be predicted by using the measurable amount of variation S3 of the gap between the journals and the movements S1 and S2 of the roll barrels, from which the strip thickness error compensating signal is calculated.

As set forth above, a strip thickness control device and method therefor in a twin roll strip casting device according to the present invention can predict the movements of the roll nip generated from the eccentricity of rolls and the movements of centers of the rolls, compensate the movement of the roll nip, and control the deviation of thickness of the strip during casting in more precise manner, to thereby improve a quality of the strip.

What is claimed is:

1. A method of controlling thickness of a strip in a twin roll strip casting device having a fixed roll and a horizontally movable roll, said method comprising the steps of:

measuring a movement value $Gj(\theta)$ of journals of said fixed and horizontally movable rolls and a movement value $Gg(\theta+\pi)$ of barrels of said rolls;

predicting a movement value $Mfcr(\theta)$ of a roll nip of said fixed roll and a movement value $Mmcr(\theta)$ of a roll nip of said horizontally movable roll in the basis of said movement values $Gj(\theta)$ and $Gg(\theta+\pi)$;

calculating a difference value between said movement values $Mfcr(\theta)$ and $Mmcr(\theta)$ to obtain an amount of variation $Mdiff(\theta)$ of a gap between the roll nip of said fixed and horizontally movable rolls; and controlling thickness of a strip by minimizing the amount of variation $Mdiff(\theta)$of the gap between the roll nip.

2. The method according to claim 1, wherein said step of predicting said movement values $Mfcr(\theta)$ and $Mmcr(\theta)$ includes the steps of:

calculating a movement value $E(\theta+\pi)$ of the roll barrel caused by the eccentricity of the roll from an expression $Gg(\theta+\pi)=E(\theta+\pi)+Gj(\theta)$ indicative of a relationship between said movement values $Gj(\theta)$ and $Gg(\theta+\pi)$;

calculating a movement value $E(\theta)$ of the roll nip caused by the eccentricity of the roll, the value $E(\theta+\pi)$ being phase-inverted by 180°; and adding the movement value $E(\theta)$ of the roll nip by the eccentricity of the roll and the movement value $Gj(\theta)$ of the journals to calculate a movement value of the roll nip.

3. A method of controlling thickness of a strip in a twin roll strip casting device, said method comprising the steps of:

detecting first and second signals indicating respectively the movements of barrels of a fixed roll and a horizontally movable roll and an amount of variation of the gap between journals of the fixed roll and the horizontally movable roll, the first and second signals being detected by a sensor;

subtracting the amount of variation of the gap between the journals of the fixed and horizontally movable rolls from each of the first signal indicative of the movement of the barrel of the fixed roll and the second signal indicative of the movement of the barrel of the horizontally movable roll to perform phase-inversion by 180° for the subtracted values;

adding the amount of variation of the gap between the journals of the fixed and horizontally movable rolls to each of the phase-inverted first and second signals and subtracting the first signal from the second signal to measure an amount of variation of a gap between roll nip; and calculating a strip thickness error compensating value to decrease the amount of variation of the gap between the roll nip.

4. The method according to claim 3, wherein said calculated error compensating value is fast Fourier transformed to eliminate a high frequency component therein by extracting only primary to third frequency components therefrom.

5. The method according to claim 3, further comprising the steps of adding a error compensating signal value without high frequency component to a desired value of roll gap; and comparing the added desired value with a roll gap measured value detected by the corresponding sensor and controlling a servo valve in accordance with a difference value between the added desired value and the roll gap measured value to control the roll gap.

6. An apparatus for controlling thickness of a strip in a twin roll strip casting device, said apparatus comprising:

a fixed roll and a horizontally movable roll;

a first sensor for measuring an amount of variation between journals of the fixed and movable rolls, the first sensor being mounted on a journal;

second and third sensors for sensing movements of barrels of said fixed and movable rolls, the second and third sensors being mounted at the surround of the rolls;

first and second subtracters for subtracting the amount of variation between the journals of said fixed and movable rolls sensed by said first sensor from each of the movements of the barrels of said fixed and movable rolls sensed by said second and third sensors;

a controlling unit for processing input signals from said first and second subtracters to calculate an amount of variation of a roll nip and eliminate a high frequency component from the calculated signal; and a roll gap controlling unit for controlling a roll gap with a signal from said controlling unit.

7. The device according to claim 6, wherein said controlling unit comprises:

first and second buffers for each storing output signals from said first and second subtracters and for inverting the phase of the stored signals by 180° to output phase-inverted signals;

first, and second adders for adding the amount of variation between the journals of said fixed and movable rolls sensed by said first sensor to output signals from said first and second buffers;

a third subtracter for subtracting the output signal of said first adder from the output signal of said second adder to calculate the amount of a variation of the roll nip;

a gap trim predictor for generating an error compensating signal by inputting the signal from the third subtracter; and a fast Fourier transforming unit for performing Fourier transform for an error compensating signal outputted from said gap trim predictor and for outputting the transformed signal out of which the high frequency component is removed.

8. The device according to claim 7, wherein said roll gap controlling unit comprises:

a fourth subtracter for adding said error compensating signal outputted from said fast Fourier transforming unit to a desired value of the roll gap and for subtracting a roll gap measured value from the added desired value;

a roll gap measuring sensor mounted between chocks of said fixed and movable rolls to measure the roll gap;

a PID controller for outputting a control signal to increase the roll gap in case of the added desired value is higher than the roll gap measured value, and to decrease the roll gap in case of lower, in accordance with the compared result of said fourth subtracter; and a servo valve for moving said movable roll in accordance with the control signal of said PID controller.

9. The device according to claim 6, wherein said first sensor includes a contact sensor.

10. The device according to claim 6, wherein said second and third sensors include a non-contact sensor.

* * * * *

UNITED STATES PATENT AND TRADEMARK OFFICE

CERTIFICATE OF CORRECTION

PATENT NO. : 6,408,222 B1
DATED : June 18, 2002
INVENTOR(S) : Yoon Ha Kim et al.

It is certified that error appears in the above-identified patent and that said Letters Patent is hereby corrected as shown below:

Column 1,
Line 32, “the rolls can not” should read -- the rolls cannot --
Line 33, “45” should read -- 45' --.
Line 34, “chocks 44” should read -- chocks 44' --.
Line 34, “of rolls 41 and 42” should read -- of rolls 41' and 42' --.
Line 35, “between the rolls 41 and 42” should read -- between the rolls 41' and 42' --.
Line 38, “between the rolls 41 and 42” should read -- between the rolls 41' and 42' --.
Line 39, “roll nip 46” should read -- roll nip 46' --.
Line 40, “fixed roll 41” should read -- fixed roll 41' --.
Line 41, “moving roll 42” should read -- moving roll 42' --.
Line 45, “an indirectly” should read -- an indirect --.
Line 47, “chocks 44” should read -- chocks 44' --.
Lines 48 and 50, “rolls 41 and 42” should read -- rolls 41' and 42' --.
Line 51, “can not” should read -- cannot --.

Column 3,
Line 49, “and 10” should read -- and 19 --.

Column 4,
Line 16, “signals S5 and S9” should read -- signals S8 and S9 --.
Line 30, “roll gap ff” should read -- roll gap if --.

Column 6,
Line 18, “signal. S3” should read -- signal S3 -- (delete period).

Column 7,
Line 16, “Fast Fourier” should read -- fast Fourier --.

UNITED STATES PATENT AND TRADEMARK OFFICE

CERTIFICATE OF CORRECTION

PATENT NO. : 6,408,222 B1
DATED : June 18, 2002
INVENTOR(S) : Yoon Ha Kim et al.

It is certified that error appears in the above-identified patent and that said Letters Patent is hereby corrected as shown below:

Column 8,
Line 50, "adding a error" should read -- adding the error --.
Line 55, "the corresponding" should read -- a corresponding --.

Signed and Sealed this

Nineteenth Day of November, 2002

*Attest:*

*Attesting Officer*

JAMES E. ROGAN
*Director of the United States Patent and Trademark Office*